US005515591A

United States Patent [19]

Reynolds et al.

[11] Patent Number: 5,515,591

[45] Date of Patent: May 14, 1996

[54] METHOD OF OPTIMIZING ASSEMBLY OF PARTS STAMPED ON DIFFERENT PRESS LINES

[75] Inventors: Thomas Reynolds, Troy; Robert A. Florian, Farmington Hills; Terrence W. Gillay, Bloomfield Twp.; John L. Myers, Romeo, all of Mich.

[73] Assignee: Chrysler Corporation, Auburn Hills, Mich.

[21] Appl. No.: 364,878

[22] Filed: Dec. 27, 1994

[51] Int. Cl.[6] ..... B23Q 17/00

[52] U.S. Cl. ..... 29/407.1; 29/464; 29/557; 29/DIG. 37

[58] Field of Search ..... 29/897.2, 407, 29/464, 557, DIG. 37, DIG. 38

[56] References Cited

U.S. PATENT DOCUMENTS

| | | | |
|---|---|---|---|
| 3,015,266 | 1/1962 | Anderson et al. . | |
| 3,218,969 | 11/1965 | Nagel . | |
| 3,851,517 | 12/1974 | Greenleaf | 72/352 |
| 4,198,906 | 4/1980 | Fujikawa et al. | 101/42 |
| 4,546,700 | 10/1985 | Kishner et al. | 101/211 |
| 4,632,667 | 12/1986 | McDonald et al. | 493/187 |
| 4,679,071 | 7/1987 | Kitagawa | 358/75 |
| 4,890,715 | 1/1990 | Sticht | 198/340 |
| 5,040,161 | 8/1991 | Jones et al. | 29/464 |
| 5,056,430 | 10/1991 | Bayerlein et al. | 101/211 |
| 5,201,589 | 4/1993 | Chun et al. | 400/134 |
| 5,247,825 | 9/1993 | Erickson | 72/339 |
| 5,327,647 | 7/1994 | Gurniak | 29/407 |

FOREIGN PATENT DOCUMENTS

| | | | |
|---|---|---|---|
| 150126 | 6/1988 | Japan | 29/DIG. 38 |
| 198932 | 8/1991 | Japan | 29/897.2 |
| 1202926 | 8/1970 | United Kingdom | 29/464 |

*Primary Examiner*—David P. Bryant
*Attorney, Agent, or Firm*—Edward A. Craig

[57] ABSTRACT

First and second stamping press lines have multiple stamping stations to serially stamp first and second parts into finished form and with bench marks reflective of the different stamping stations that also interrelate with one another to show if the stations are stamping to specifications. The marks on a part finished by the first line ideally match with the marks on a part finished by the second stamping line providing a visual indicator of quality so that the two separate parts can be permanently secured together with assurance of a quality assembly. Bench marks on separate parts that do not align or conform with one another identify stamping lines and stamping stations requiring adjustment or repair.

6 Claims, 4 Drawing Sheets

FIG - 7
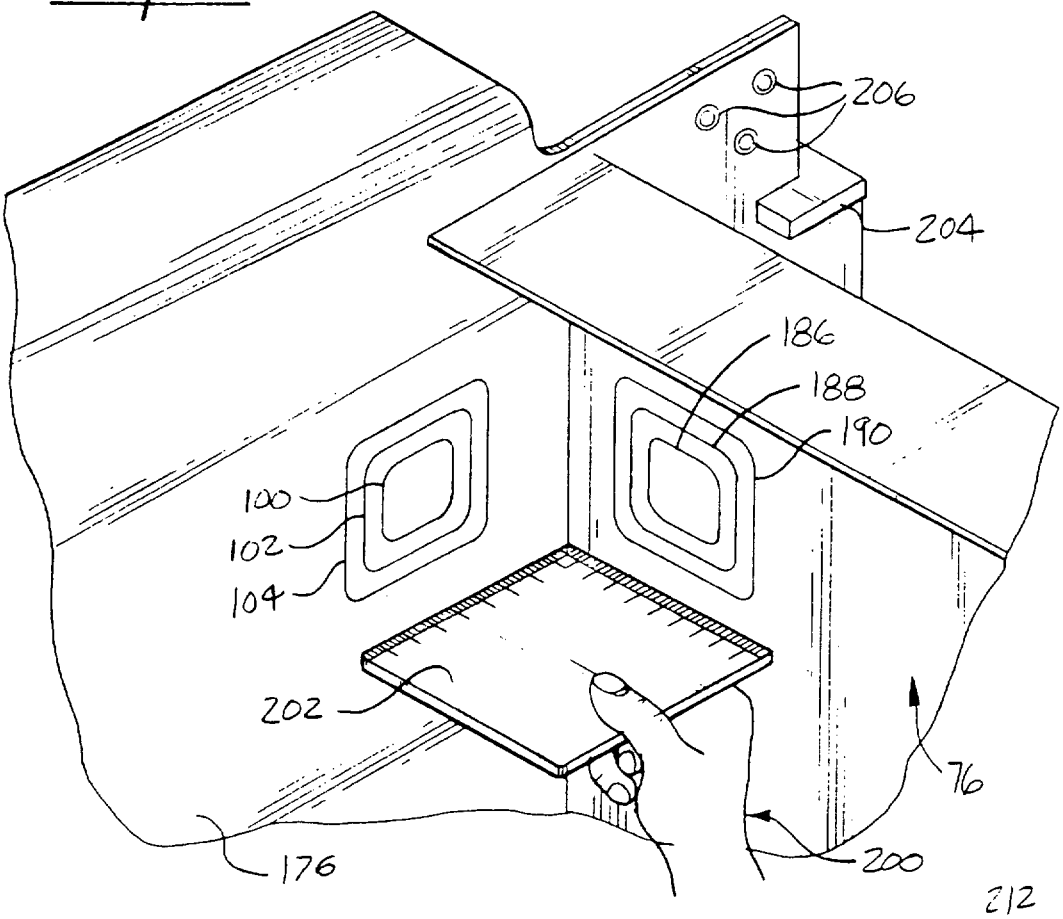
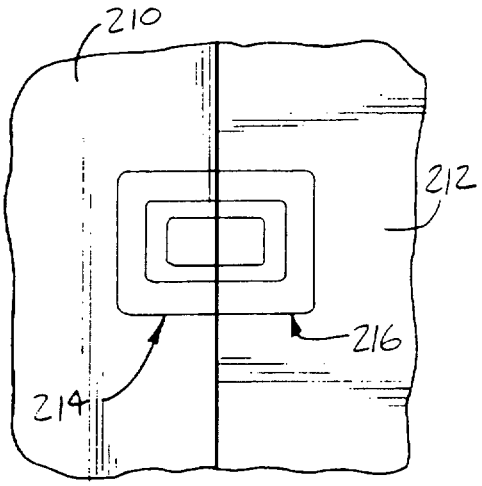
FIG - 8
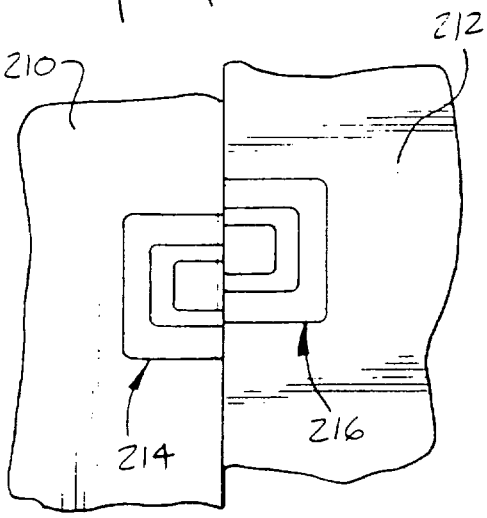
FIG - 9

METHOD OF OPTIMIZING ASSEMBLY OF PARTS STAMPED ON DIFFERENT PRESS LINES

TECHNICAL FIELD

This invention relates to multi-station press line stamping, and more particularly, to a new and improved method of stamping separate parts in press lines, and subsequently, matching and securing the stamped parts together into a quality assembly.

BACKGROUND OF THE INVENTION

Prior to the present invention, various methods and mechanisms have been utilized to improve the precision stamping of parts so that there is better fit of the stamped parts to provide high quality assemblies made from a plurality of stamped parts. For example, special guide pins have been used to accurately guide upper and lower dies moved in a press between open and closed positions so that a part will be accurately stamped by the dies. Furthermore, gages have been utilized within the dies to stabilize the blank or part being struck so that the stamped part will meet requirements. Also parts have been stamped in preliminary runs in press lines, and subsequently, gaged to ascertain that the stamped parts meets specifications. If such parts do not meet specifications, appropriate adjustments are made in the dies and other critical press line components until the stamped parts meet with approval. Such procedures, while satisfactory, are time consuming and costly and generally do not meet requirements for high quality and quantity output.

In many respects, improved stampings have been obtained by the "Multiple Stamping Dies With Cumulative Stamping Markers and Methods Of Stamping Parts" of application Ser. No. 358,508, (Chrysler docket No. 941634), now U.S. Pat. No. 5,471,923, assigned to the assignee of this invention and hereby incorporated by reference. In that application, a multiple station stamping press line is disclosed with die sets having special bottoming markers which imprint bench marks on the part at each stamping station to provide a readout on the finally stamped part that reveals the accuracy of stamping at each station and identifies any station that is not stamping to specifications.

While repeatable stampings of high quality have been provided using the markers and methods of the above identified application, assemblies of parts coming from different press lines often did not properly match with one another to meet higher standards needed for quality and quantity production. To achieve such goals, the present invention provides for the serial marking of the parts being stamped along different press lines with bench marks that interrelate with one another. With the parts having bench marking that relate to one another regardless of the press line that produces the part, the parts can, by using the bench marks, be accurately positioned relative to each other and held until secured into a permanent assembly with optimized accuracy.

It is a feature, object and advantage of this invention to provide new and improved press line stamping procedures in plural press lines of multiple stamping stations. Preferably, each station is equipped with a die set with bottoming markers that apply bench marks to the parts being stamped in each line that interrelate to the parts being stamped so that parts from a first line can be matched by the bench marks to the parts from a second line for optimizing quality of the assembly of parts coming from different press lines.

These and other features, object and advantages of this invention will become more apparent from the drawings and the following written matter:

BRIEF DESCRIPTION OF THE DRAWINGS

FIG. 7 is a pictorial view of the parts finally stamped by the stamping lines of FIGS. 1 and 5 clamped together and permanently joined together; and FIGS. 8 and 9 are diagrammatic views showing other separately stamped parts and marked with bottom markers in separate press lines before being fastened together.

DETAILED DESCRIPTION OF THE DRAWINGS

Figure 1:
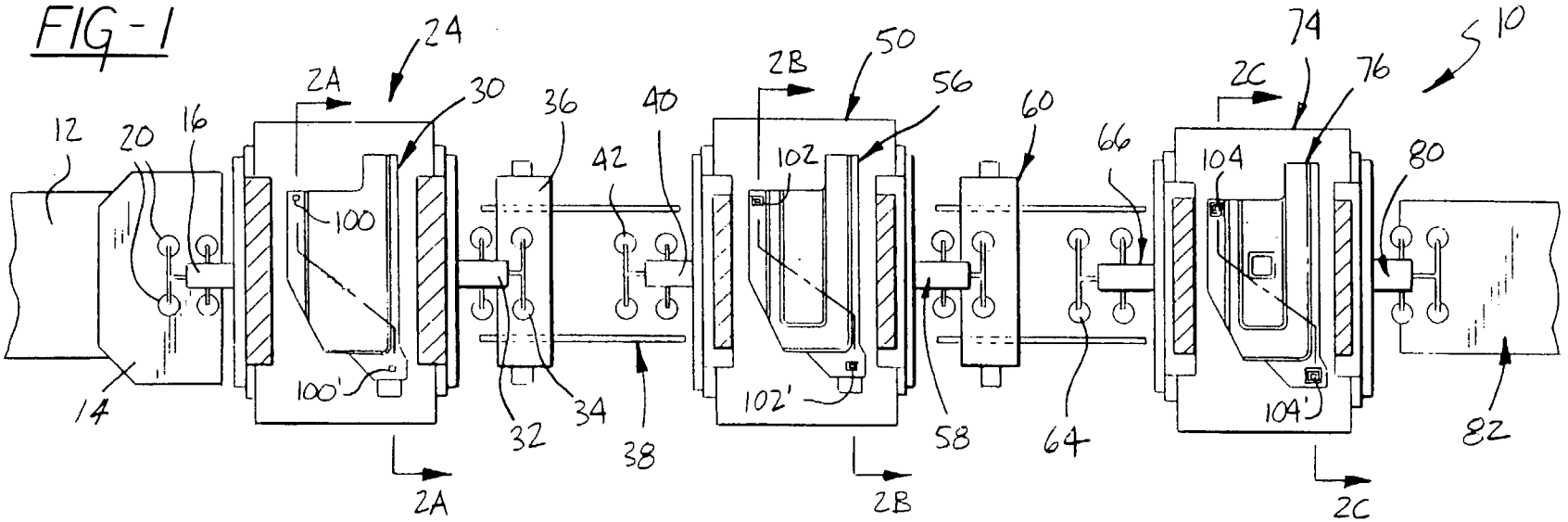
FIG. 1 is a diagrammatic top view of a first stamping press line having multiple stamping stations.

Turning now to greater detail to the drawing, there is diagrammatically shown in FIG. 1 a multi-station stamping press line 10 including a loading station 12 supporting a supply of sheet metal blanks 14 which can be serially moved by a retractable loader 16 with suction cups 20 into a first stamping die set 22 of a first stamping station 24 of the press line 10.

Figure 2C:
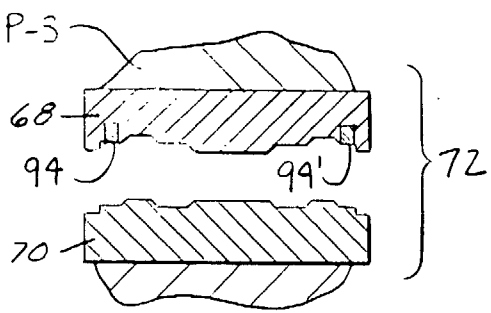
FIGS. 2*a*, 2*b* and 2*c*, respectively, are diagrammatic cross-sectional views of stamping dies to be used with the press line of FIG. 1 and taken along sight lines 2*a*—2*a*, 2*b*—2*b*, and 2*c*—2*c* of FIG. 1.
Figure 2B:
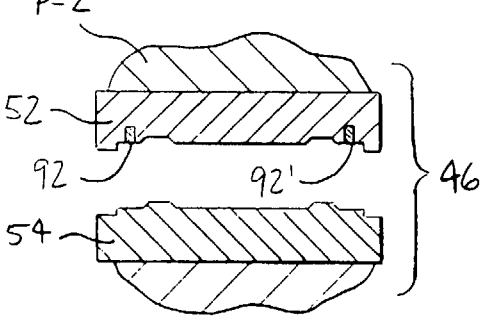
Figure 2A:
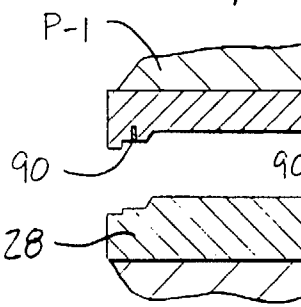

The first stamping die set 22 has upper and lower dies 26, 28 diagrammatically shown in cross section in FIG. 2*a*. The first die set 22, as well as the others of the stamping press line, are operated by conventional presses P-1, P-2, P-3, respectively, which move the dies between open and closed positions such as disclosed in U.S. Pat. No. 3,851,517 entitled "Process for Manufacturing curved Channel Members" issue Dec. 3, 1974 to J. P Greenleaf which is hereby incorporated by reference.

The upper and lower dies 26, 28 of die set 22 are configured to stamp the sheet metal blanks 14 into a first contoured form 30 of a part, such as a cowling, in a first stage stamping operation. After the initial stamping in which the blank is formed and trimmed into the first form, the dies are opened and the first form 30 is transferred from the first die set of station 24 by an unloader 32 having suction cups 34 which are operated to hold the first form 30 by vacuum while the unloader arm moves the first form 30 onto a transfer carriage 36 movable along rail way 38 to an end position at which loading mechanism 40 with suction cups 42 is operated to load the first form into a second die set 46 at a second stamping station 50.

The second die set 46 has upper and lower dies 52, 54 operatively mounted in the press P-2 of the stamping press line 10. After the first form has been restruck by operation of die set 46 and press P-2 into a second stamped form 56, the second form is moved by an unloader 58, which is like the first station unloader 32, from the second die set 46 onto the transfer carriage 60. This carriage is movable along rails 62 to a loading station at which the suction cups 64 of loader 66 are engaged at locations on the second stamped form 56 so that they can, as the other loaders and unloaders, be evacuated of air and the part 56 can be retained on the loader by atmospheric pressure.

The loader 66 then retracts and moves the second form 56 into the open dies 68, 70 of the third die set 72 of the third stamping station 74. After being seated therein, the vacuum of the cups 64 is broken and the loader is retracted from the dies such as in any conventional loading and unloading devices. As in previous stamping operations, the dies of die set 72 are then closed, as diagrammatically illustrated in FIG. 2*c*, by the associated press P-3 in the press line 10. This action stamps the part into its third configuration or finished part 76 shown in FIG. 1. The finished part 76 is then removed from the third die set 72 by the unloader 80 onto the conveyor 82 which moves the stamped and finished part 76 to an assembly point.

In view of the wide size variations found in parts stamped in prior stamping press lines, and with increasing demand for closer held tolerances in stamped parts, pairs of matched sets of bottom markers are provided. One of the bottom markers 90 is shown in cross-section in FIG. 3 and is installed in the upper die 26 by a threaded fastener 91. The other markers 92, 94 of this marker die set are installed in the die sets 46 and 72 so that they correspond in location to marker 90. The markers of each set of bottom markers are serially employed with the die sets 22, 46, 72, to provide the mechanism to ensure that the parts are stamped to higher standards and closer tolerances and to quickly and accurately identify any stamping station or stations that are not stamping parts to specification.

Figure 3A:
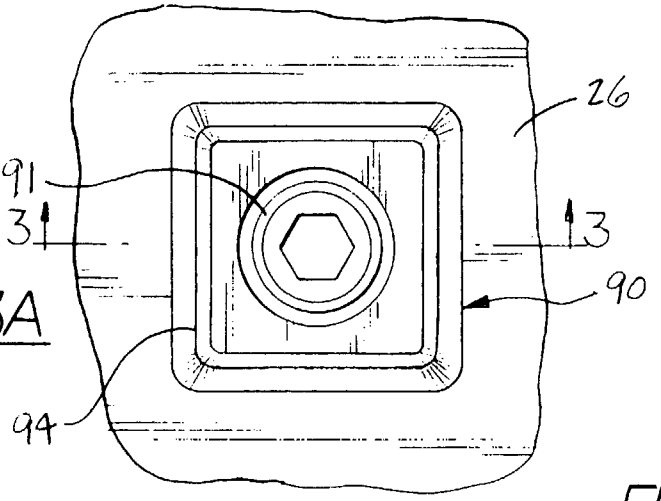
FIG. 3*a* is a bottom end view of one of the bottoming markers of this invention.
Figure 3:
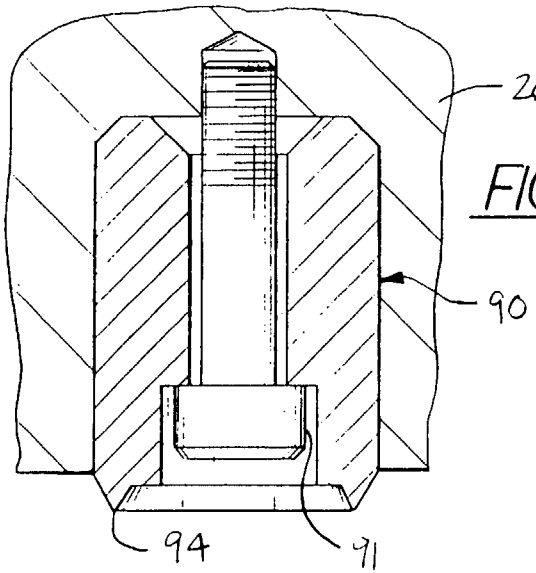
FIG. 3 is a cross-sectional view taken along sight lines 3—3 of FIG. 3*a;*

More particularly, the bottoming markers have outboard faces with raised indentors or markers, such as shown at 94 in FIG. 3, to impress permanent indentations or bench marks in the part as the part is being stamped at the various stamping stations when progressing through the die line 10. Preferably, the bench marks are a series of similar geometric figures whose corresponding angles are equal and whose corresponding sides are in proportion. Accordingly, the bottom marker 90 produces the generally rectilinear geometric mark 100 diagrammatically shown in FIG. 4*a*. Marker 92 produces a similar but larger mark 102 in the second form 56 shown in FIG. 4*b*. Bottom marker 94 of the third die set produces a similar but still larger corresponding mark 104, shown in FIG. 4*c*.

Figure 4C:
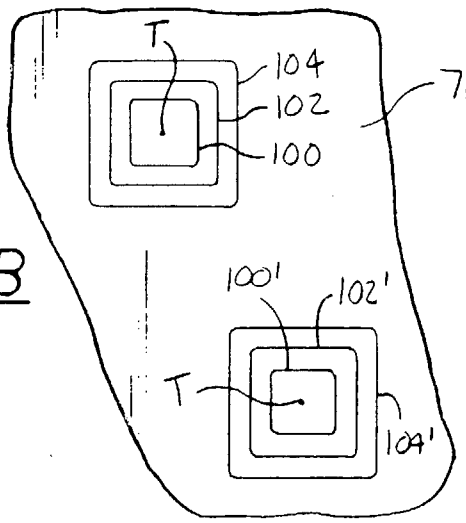
FIGS. 4*a*, 4*b*, 4*c*, respectively, are fragmentary top views showing portions of a metal cowl as serially stamped in the stamping stations of FIG. 1.

Since the marking dies 90, 92 and 94, are all aimed at the same target point, point T, on the part as it is being progressively stamped while being moved down the stamping line 10, the marks will accumulate into a "concentric" form assuming that there is good gaging and alignment of the upper and lower dies of each die set. The markings, accordingly, are serially applied and accumulate into a "bulls eye" configuration, such as shown in FIG. 4*c*.

With such a configuration, a line operator or other observer standing at the conveyor 110 at the end of the line 10 can quickly observe the impressed and distinct markings to determine by the "bulls eye" configuration if all the stations are stamping to specifications.

In the preferred embodiment, first and second sets of marker dies are used in the die sets of the multi-station stamping line 10.

As best shown in FIG. 1, the marker dies 90, 92 and 94 of the first set are located at corresponding first specific points in the upper dies of the die sets of the stamping stations. The cooperating marker dies 90', 92', 94', of the second set of marker dies, are located at second specific points in the upper dies of the die sets of the stamping stations.

Figure 4B:
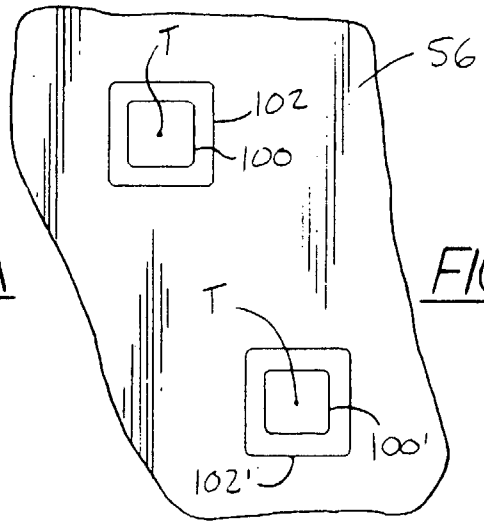
Figure 4A:
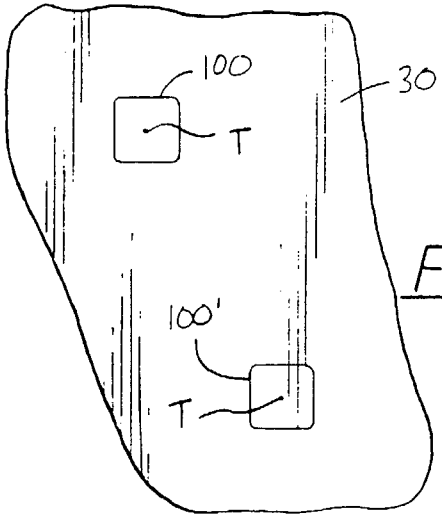

If the dies of the die sets are appropriately aligned, and if the gaging in the die sets is correct, the markings produced on the part as it is being stamped by the pairs of marker dies 90, 90', 92, 92' and 94, 94' will progress into concentricity as diagrammatically shown in FIGS. 4*a* through 4*c*. Since there are resultant pairs of markings applied to the stamped part at each station, such as 100, 100' at station 24 and 100, 100' plus 102, 102' at station 50, and 100, 100'; 102, 102' plus 104, 104' at station 74, the concentricity of the markings assures that there has been no appreciable turning of the part in the die set as the part is being stamped and particularly about the center or target T, T' of either one of the matched "bulls-eyes 180 and 180'" of FIG. 4*c*. In the event of any turning movement about either one of the centers of the "bulls-eye", the rings of the other of the "bulls-eye" of the associated stamping station in which the parts are turning would be readily identifiable by any eccentricity on the markings. Accordingly, the pairs of markings practically eliminates any false readings.

Additionally, by observing or in some instances measuring the depth of the bench marks, press loads can be confirmed. If, for example, the press load is too low, the bench mark will be shallow indicating need for press load correction.

Figure 5:
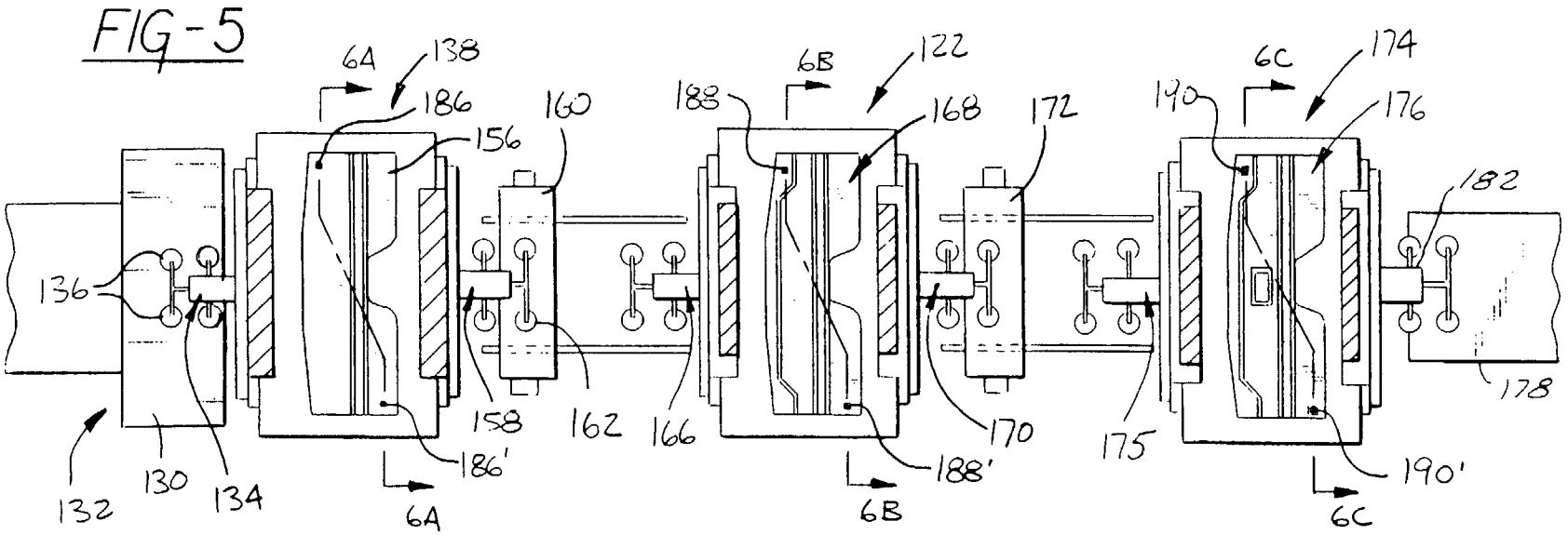
FIG. 5 is a diagrammatic top view of a second stamping line having multiple stamping stations for stamping a second part of an assembly.
Figure 6C:
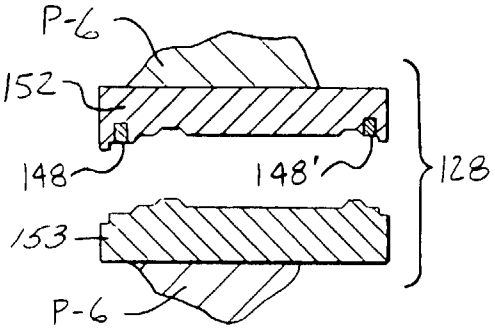
FIGS. 6*a*, 6*b* and 6*c*, respectively, are cross-sectional views of the stamping dies to be used in stations of FIG. 5 taken along sight lines 6*a*—6*a*, 6*b*—6*b*, 6*c*—6*c* of FIG. 5.
Figure 6B:
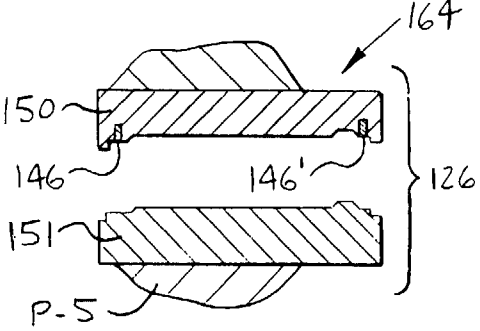
Figure 6A:
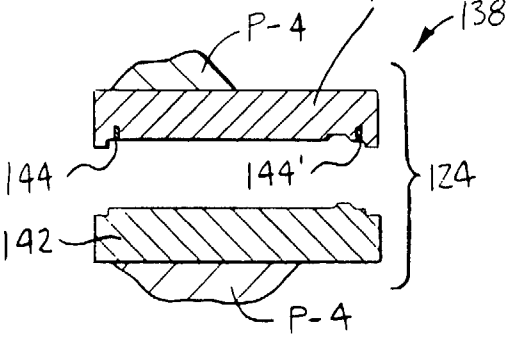

In accordance with this invention, a dash panel or second finished part 176 to be joined to the cowl or first part 76 is stamped in a second multi-station stamping press line 122. As shown in FIG. 5, the second press line 122 is, with the exception of the stamping die sets 124, 126 and 128, substantially the same as the first line 10. More particularly, sheet metal blanks 130 are serially unloaded from a supply station 132 by the retractable loader 134 using suction cups 136 and transferred into the die set 124 of the first stamping station 138 of press line 122. As in the die sets of the first press line, the die set 124 has upper and lower dies 140, 142 mounted in press P-4. Also, as in the first press line, the die set 124 as well as the other die sets of the second press line have sets of bottom markers 144, 144', 146, 146' and 148, 148' strategically placed in the upper dies of the respective die sets.

After being transferred into the die set of the first station 138, the blank 130 is stamped in a first form by closure of the dies 140, 142 under press load. After such stamping, the part is unloaded by the mechanism 158 onto the transfer carriage 160 where it is released from the action of the suction cups 162. The carriage 160, operatively mounted on rails, transfers the first part 152 to a load position adjacent to the second stamping stations 164. At this point, the loader mechanism 166 picks up the first form 156 by action of the associated suction cups to move it into the die set 126 of the second station 164, where it is restruck by the upper and lower dies 150 and 151 of the second die set 164 under load of the press P-5 into a second form 168. In a continued sequential manner, the second form of the part 168 is unloaded from the die set 126 of the second station by the unloader 170 which is like the other loader and unloader mechanisms and is operated to move the second form 168 onto transfer carriage 172. The transfer carriage, like the other carriages described, moves the stamped part to a part unloading position along the press line 122 adjacent to a third stamping station 174. A loader 175 picks up the second form 168 of the part and moves it into the third die set 128 where it is restruck by the upper and lower dies 152, 153 into the second finished part 176.

The second finished part is then subsequently moved from the die set 128 onto the transfer line 178 by the unloader mechanism 182. The transfer line then moves the second finished part 176 into the assembly point where it is to be joined to the first finished part.

While the part is being finished, the bottom markers 144, 144', 146, 146', and 148, 148' strategically located in the upper dies of the die sets 124, 126 and 128 of the second line 122 are used to place bench marks onto the second part as it is being stamped along the line in a manner similar to that described in connection with the first line. The bottom markers are substantially the same in construction as the bottom markers of the die set of the first press line illustrated by FIGS. 3, 3*a*, 4*a*, 4*b*, and 4*c* to produce pairs bottoming marks 186, 186', 188, 188' and 190, 190', which are similar to the first part bottoming or bench marks, on the second part as it is being stamped and reformed in the second press line.

Also, as with the first part, the bench marks accumulate into concentric orientation if the die sets are stamping to specifications. If the bottom bench marks are not "concentric", the stamping line and specific presses can be readily identified by their bench mark and repaired or adjusted as needed.

Turning now to FIG. 7, the parts 76 and 176 are moved into position with respect to one another at the assembly point preferably at the end of the transfer lines. The assembler 200 can then readily by sight or by using a gaging tool 202 ascertain that the bench marks of the two parts align with one another. With the parts in alignment, they can be clamped or held in a fixture 204, or otherwise held, so that they can be permanently secured together such as by spot welds 206. Accordingly, the cowl can be assembled with the dash panel structure with assurance that the two parts have been accurately stamped and that the two press lines are effectively working together to produce high quality parts for assembly together.

In the event that separate parts such 210 and 212 are stamped on separate press lines and have bench marks 214, 216 stamped therein that extend to the abutment edges of the parts as shown in FIG. 8, such bench marks can be sensed by automatic scanners or directly used to accurately tell whether or not the stampings are being properly made. The accurate bench mark alignment such as shown in FIG. 8 advises the assembler of the desired high quality stamping.

In FIG. 9, it will be seen that the two bench marks 214, 216 of stamped parts 210 and 212 fitted together at their abutment edges are not in alignment with one another. The assembler or automatic scanner recognizing the visual quality indicators provided by the bench mark mismatch knows that adjustment of the press line die sets or repair of parts thereof is required. When the parts subsequently match up as in FIG. 8, the assembler knows that the press line problems have been corrected and that the lines are ready for high volume quality production.

While a preferred method and embodiment of the invention has been shown and described, other methods and embodiments will now become apparent to those skilled in the art. Accordingly, this invention is not to be limited to that which is shown and described but by the following claims.

What is claimed is:

1. A method of making separate parts and subsequently fastening said separate parts into a unitized assembly comprising the steps of:

a. separately stamping first and second blanks into first and second forms, respectively, at first stations of separate first and second press lines while respectively imprinting said first and second forms with first and second bench markings at predetermined places thereon, b. subsequently stamping said first and second forms into third and fourth forms, respectively, at second stations in said first and second press lines respectively while respectively imprinting said third and fourth forms with third and fourth bench markings spaced in relationship to said respective first and second markings, c. removing said third and fourth forms from said press lines, d. comparing said first and second and third and fourth bench markings on each of said third and fourth forms with predetermined specifications to ascertain if the third and fourth forms have been stamped according to such predetermined specifications, e. subsequently positioning said third and fourth forms in relationship to one another by using said bench markings respectively imprinted thereon as alignment guides, and f. securing said third and fourth forms together.

2. The method defined in claim 1, wherein said third and fourth forms are permanently secured to one another into an assembly based on the correspondence of said first and second and said third and fourth bench markings with one another.

3. The method defined in claim 1, wherein said first and second forms are respectively imprinted with substantially identical first and second bench markings at said first stations, and wherein said third and fourth forms are respectively imprinted with substantially identical third and fourth bench markings at said second stations.

4. The method of claim 3, wherein said first and second forms are respectively imprinted with substantially identical first and second bench markings at said first stations which extend to abutment edges of said first and second forms and said third and fourth forms are respectively imprinted with third and fourth bench markings which extend to said abutment edges of said third and fourth forms, and said first and second markings and said third and fourth markings are subsequently aligned with one another.

5. A method of making discrete first and second parts respectively on first and second stamping press lines and subsequently joining said first and second parts comprising the following steps:

a. stamping the first part in a first press line in which the first part is changed in formation in a number of stamping stations of said first press line, b. providing a discrete bench mark on said first part at each of said stamping stations of said first line which are similar to one another, and which are targeted on a common point on said first part, and which have corresponding angles that are equal and whose corresponding sides are in proportion, c. stamping the second part in a second press line in which the second part is changed in formation in a number of stamping stations of the second press line, d. providing a discrete bench mark on said second part at each of said stamping stations of said second line which are similar to one another and to the bench marks on said first part, and which are targeted on a common point on said second part and which have corresponding inner angles that are equal and whose corresponding sides are in proportion, e. positioning said first and second parts together, f. matching said bench marks of said first and second parts to one another, g. permanently securing said parts to one another into an assembly if said bench marks of said first and second parts align with one another.

6. A method of stamping a first sheet metal part in a plurality of stations of a first stamping press line and a second sheet metal part in a plurality of stations of a second stamping press line and subsequently joining said first and second sheet metal parts in a permanent assembly comprising the steps of:

a. progressively applying similar bench marks of different sizes in accordance with the station of said first line to said first part at a number of said stamping stations of said first line, b. progressively applying similar bench marks of different sizes in accordance with said station of said second line to said second part as it is progressively stamped by said second line, c. effecting the positioning of said first and second part in accordance with the alignment of said first and second bench marks, and d. securing said first and second parts together into an assembly.

* * * * *